US005244091A

United States Patent [19]

Tannenbaum

[11] Patent Number: 5,244,091

[45] Date of Patent: * Sep. 14, 1993

[54] DEVICE FOR INHIBITING REMOVAL OF AN ARTICLE FROM A BLISTER CONTAINER

[75] Inventor: Michael A. Tannenbaum, Freehold, N.J.

[73] Assignee: PCI/Delvco, Inc., Ivyland, Pa.

[ * ] Notice: The portion of the term of this patent subsequent to Sep. 29, 2009 has been disclaimed.

[21] Appl. No.: 822,521

[22] Filed: Jan. 17, 1992

Related U.S. Application Data

[63] Continuation-in-part of Ser. No. 778,047, Oct. 16, 1991, Pat. No. 5,150,793.

[51] Int. Cl.[5] ..... B65D 83/04

[52] U.S. Cl. ..... 206/462; 206/469; 206/531; 206/532; 206/539; 221/25; 221/87; 221/89

[58] Field of Search ..... 206/531, 532, 539, 538, 206/462, 469; 221/5, 25, 87–89

[56] References Cited

U.S. PATENT DOCUMENTS

| | | | |
|---|---|---|---|
| 2,921,672 | 1/1960 | Ivy et al. | 206/538 X |
| 3,276,573 | 10/1966 | Kaufman et al. | 206/531 |
| 3,279,651 | 10/1966 | Thompson | 206/531 X |
| 3,324,996 | 6/1967 | Jordt | 206/531 |
| 3,387,699 | 6/1968 | Heller | 206/531 |
| 3,651,927 | 3/1972 | Richardson et al. | 206/531 X |
| 4,074,806 | 2/1978 | Ardito | 206/531 |
| 4,384,649 | 5/1983 | Brodsky | 206/538 |
| 5,109,984 | 5/1992 | Romick | 206/531 |
| 5,150,793 | 9/1992 | Tannenbaum | 206/531 |

FOREIGN PATENT DOCUMENTS

| | | | |
|---|---|---|---|
| 264733 | 8/1990 | France | 206/531 |

*Primary Examiner*—Bryon P. Gehman

*Attorney, Agent, or Firm*—Panitch, Schwarze, Jacobs & Nadel

[57] ABSTRACT

The present invention is a device for inhibiting removal of a first article from a first blister-type container having at least one blister. The device includes a first member or second blister-type container positioned facing the first blister-type container with at least one opening in the second container in registry with the blister when the second container is in the first position. The first container likewise may include an opening in registry with a second blister of the second container when the second container is in the first position. The openings in the first and second containers are sized to permit passage of the respective articles therethrough. When the second container is in the second position, the second container is positioned to inhibit removal of a first article from the first container and the first container is positioned to inhibit removal of a second article from the second container. The device may also include a first member for permitting movement of the second container between the first and second positions and a second member for maintaining the second container proximate the container and permitting movement of the second container between the first and second positions. A locking member may be provided for locking the containers in the second position.

19 Claims, 4 Drawing Sheets

DEVICE FOR INHIBITING REMOVAL OF AN ARTICLE FROM A BLISTER CONTAINER

CROSS REFERENCE TO RELATED APPLICATION

This application is a continuation-in-part of copending U.S. patent application Ser. No. 07/778,047, filed Oct. 16, 1991, now U.S. Pat. No. 5,150,793.

FIELD OF THE INVENTION

The invention relates to a device for inhibiting the removal of an article from a blister package-type container and, more particularly, to a child-resistant device for inhibiting removal of an article from a blister package.

BACKGROUND OF THE INVENTION

Each year, thousands of children are injured by ingesting articles such as pharmaceutical products. For example, pills, tablets, and capsules of pharmaceutical products are often shaped, sized, and colored for the convenience of adults, yet represent an attractive hazard to young children unaware of the danger of ingesting such products. Young children may also be injured by playing with other pharmaceutical products, such as syringes.

Many pharmaceutical products, such as pills, tablets, capsules, syringes and other such articles, are packaged in so-called blister-type packages or containers to facilitate removal but to inhibit contamination and product tampering. Typically, the article is sandwiched between a layer of transparent or translucent plastic in the form of an outward extension, cavity or blister and a rupturable or puncturable layer. Force applied to the blister in the plastic layer is transmitted to the article, which ruptures or punctures the puncturable layer for removal of the article by the user.

While government regulations require child-resistant caps on bottles and vials of many pharmaceuticals, there exists a need in the art for a device which inhibits the removal by children of articles such as pills, syringes, etc. from blister-type containers.

SUMMARY OF THE INVENTION

Briefly stated, the present invention comprises a device for inhibiting removal of a first article from a first blister-type container. The first container comprises a first generally flat sheet having first and second sides and at least one formed cavity or blister for accommodating the first article. The first container also comprises a puncturable generally flat second sheet having first and second sides. A portion of the first side of the second sheet engages a portion of the first side of the first sheet to form the container. The device further comprises a first generally flat member having first and second sides and at least one opening extending therethrough, the opening sized to permit passage of the first article therethrough. A portion of the first side of the first member is in facing engagement with a portion of the second side of the second sheet. The first member is movable with respect to the first container between a first position and the second position. When the first member is in the second position, the first side of the first member is positioned facing the second side of the second sheet to inhibit removal of the first article from the first container. When the first member is moved by a user to the first position, the blister is in registry with the opening to permit removal of the first article from the first container. The first article may be removed from the first container by applying pressure to an outside surface of the blister to force the first article to puncture the second sheet of the first container and pass through the opening.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred, it being understood, however, that the invention is not limited to the specific methods and instrumentalities disclosed. In the drawings.

DESCRIPTION OF THE PREFERRED EMBODIMENTS

Figure 1:
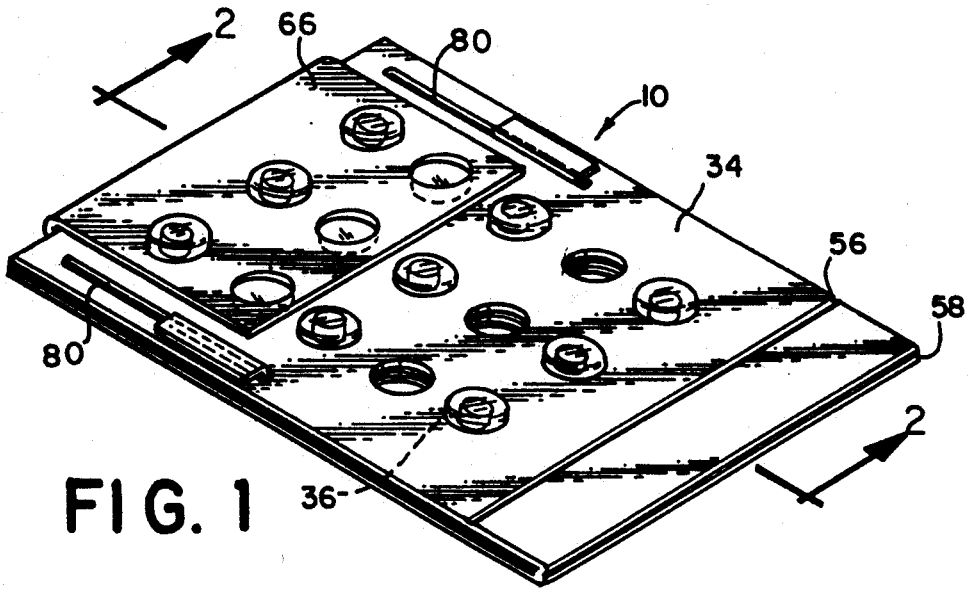
FIG. 1 is a perspective view of a preferred embodiment of a device for inhibiting removal of an article from a blister-type container, in accordance with the present invention.

Certain terminology is used in the following description for convenience only and is not limiting. The words "outwardly", "right" and "left" designate directions in the drawings to which reference is made.

Referring to the drawings, wherein like numerals indicate like elements throughout, there is shown in FIG. 1 a device, generally designated 10, in accordance with the present invention. The device 10 is for inhibiting removal of at least a first article and preferably a plurality of articles 12 from a first blister-type package or first container 14.

Figure 2:
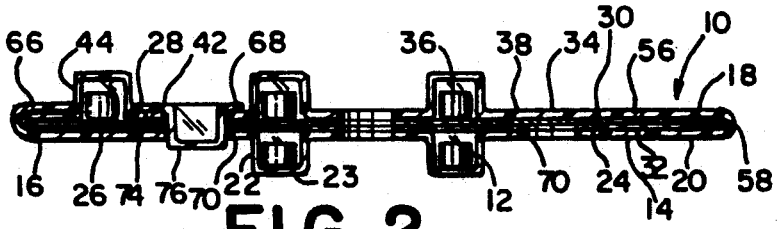
FIG. 2 is a cross-sectional view of the device taken along line 2—2 of FIG. 1.

As best shown in FIG. 2, the first articles 12 are preferably selected from the group consisting of pills, tablets, capsules, syringes and suppositories, although one of ordinary skill in the art would understand that the first article or articles 12 may be any article or product packaged in a blister-type package or container 14. One of ordinary skill in the art would also understand that the articles 12 need not be restricted to pharmaceutical articles, but may be any other type or style of article such as a screw, nut, bolt, razor, etc.

Figure 7:
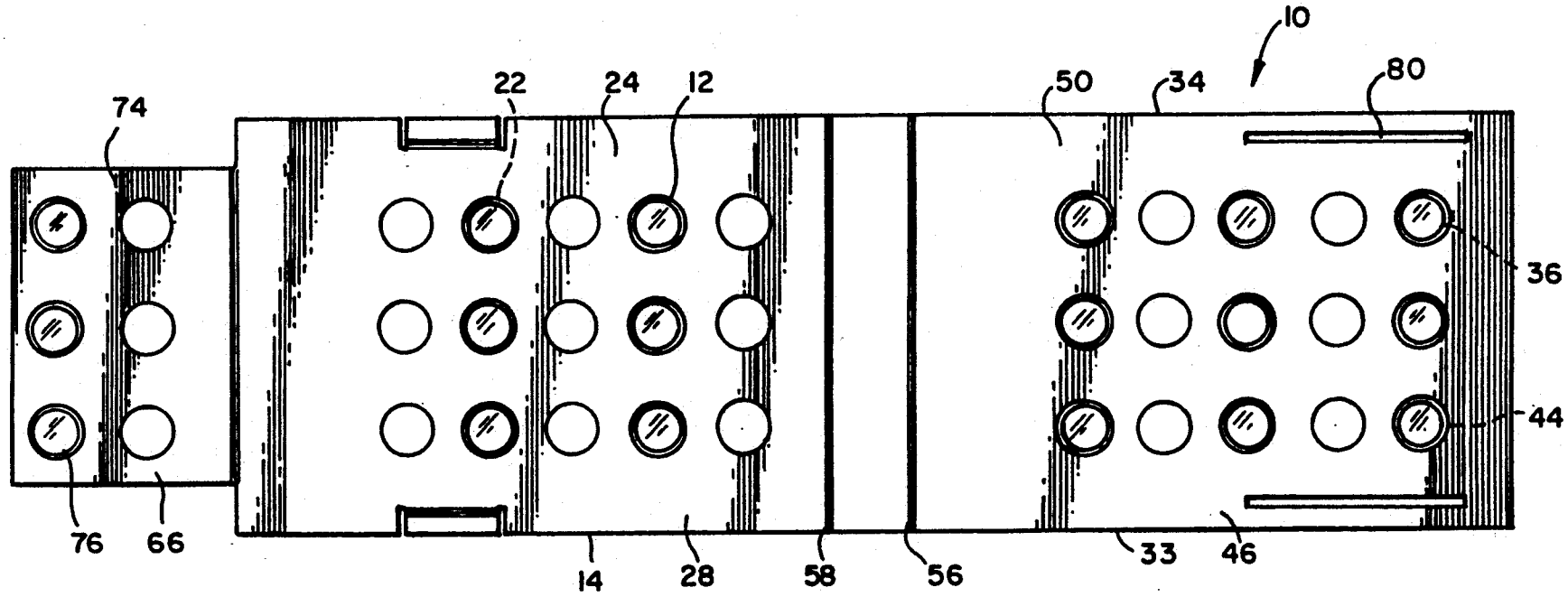
FIG. 7 is a top plan view of the device of FIG. 1 prior to final assembly, wherein the locking means is in an open position and the first member is spaced away from the first container.

Preferably, the first blister-type container 14 comprises a slightly modified conventional blister package, best shown in FIG. 7. However, one of ordinary skill in the art would understand that the first blister-type container 14 may take any shape or form in accordance with the spirit and scope of the present invention.

As best shown in FIG. 2, the first container 14 comprises a first generally flat sheet 16 formed of a generally compressible, formable material which allows pressure applied to the first sheet 16 to be transmitted to the articles 12 to remove the articles 12 from the first container 14.

The first sheet 16 is preferably formed from a formable polymeric or thermoplastic material, such as one selected from the group consisting of polyvinyl chloride, styrene, propylene, nitrile-based barrier resin, chlorotrifluoroethylene, polyethylene terephthalate (PET), polyethylene terephthalate glycol (PETG), and amorphous polyethylene terephthalate (APET), including laminations or coextrusions thereof. For example, a preferred nitrile-based barrier resin is BAREX TM, which is commercially available from BP Chemicals of Cleveland, Ohio. A preferred chlorotrifluoroethylene film is ACLAR TM which is commercially available from Allied Signal, Inc. of Morristown, N.J. One of ordinary skill in the art would understand that other polymeric materials different from those set forth above or any other generally compressible, formable material such as aluminum may also be used for forming the first sheet 16 of the first container 14. Generally, the material should be selected in accordance with the chemical and/or mechanical characteristics of the articles 12 and should be capable of being formed to accommodate the size and shape of the articles 12.

As best shown in FIG. 2, the first sheet 16 has a first side 18 and a second side 20. The first sheet 16 also has at least one, and preferably a plurality of, generally outwardly extending blisters 22 for accommodating the articles 12. The interior dimensions of the blisters 22 preferably conform to the size and shape of the one or more articles 12 contained therein. One of ordinary skill in the art would understand that the first sheet 16 need not be generally flat, and may have blisters 22 of any size and shape in keeping with the spirit and scope of the present invention.

As best shown in FIG. 7, the first container 14 includes a rupturable or puncturable generally flat second sheet 24. The second sheet 24 is preferably generally rupturable by the articles 12 in the area of the blisters 22 when a force is applied to a blister 22 of the first sheet 16 for dispensing one or more of the articles 12. The force may be generated by the pressure of one or more fingers or the thumb of an individual, for example.

Preferably, the second sheet 24 is a metallic foil, such as aluminum foil. However, one of ordinary skill in the art would understand that any other rupturable or puncturable material, such as a plastic material of the type described above in connection with the first sheet 16 or a paper material, may be used for the second sheet 24.

One of ordinary skill in the art would understand that the second sheet 24 need not be generally flat, and may have ridges or indentations, etc. Preferably, the second sheet 24 generally conforms in size to the first sheet 16, but one of ordinary skill in the art would understand that the second sheet 24 may be larger or smaller than the first sheet 16, as desired.

As best shown in FIG. 2, the second sheet 24 has a first side 26 and a second side 28. A portion 30 of the first side 26 of the second sheet sealingly engages a portion 32 of the first side 18 of the first sheet 16 to form the first container 14. The sealed, engaging portions 30, 32 generally do not include the area of the blisters 22. Preferably, the engaging portions 30, 32 are heat-sealed or adhesively engaged to each other. For purposes of clarity in the drawings, the adhesive or heat seal coating is not shown. One of ordinary skill in the art would understand that the portion 30 of the second sheet 24 may be engaged with the portion 32 of the first sheet 16 by some other means, such as by fasteners, etc.

The first blister package or container 14, as described above, is a typical blister package well known to those skilled in the art. One or more of the articles 12 may be removed from the first container 14 by applying pressure to an outside surface 23 of a blister 22 to force the article 12 to rupture or puncture the second sheet 24. One of ordinary skill in the art would understand that the pressure necessary to puncture the second sheet 24 with the first article 12 is, among other criteria, a function of the shape and compressibility of the first article 12, as well as the compressibility, thickness and type of material from which the first sheet 16 and second sheet 24 are formed. The pressure is generally that which is capable of being generated by one or more fingers or the thumb of an individual.

The present invention provides an improvement upon the above-described typical blister-type container by making the container child-resistant. As best shown in FIG. 7, the present invention includes a first generally flat member 33. The first member 33 is preferably formed from a material having sufficient strength to resist puncture by the articles 12 when pressure is applied to the outside surface 23 of a blister 22 in an attempt to remove an article 12 from the first container 14. The first member 33 may be formed, for example, from paper, cardboard or a polymeric material of the type described above in connection with the first sheet 16.

Preferably, the first member 33 comprises a second blister-type container 34 or conventional blister package substantially the same as the first blister-type container 14 and made of the same materials. However, one of ordinary skill in the art would understand that the second blister-type container 34 may take any shape or form in accordance with the spirit and scope of the present invention.

The second blister-type container 34 may contain at least one and preferably a plurality of second articles 36, such as one of the articles selected from the group of first articles 12 discussed above. Preferably the second articles 36 are the same as the first articles 12 or are complementary to the first articles 12. However, one of ordinary skill in the art would understand that the second articles 36 may be of a different type than the first articles 12 and likewise need not be restricted to pharmaceutical articles, but may be any other type or style of article, for example, screws, nuts, bolts, razor blades, etc.

Figure 3:
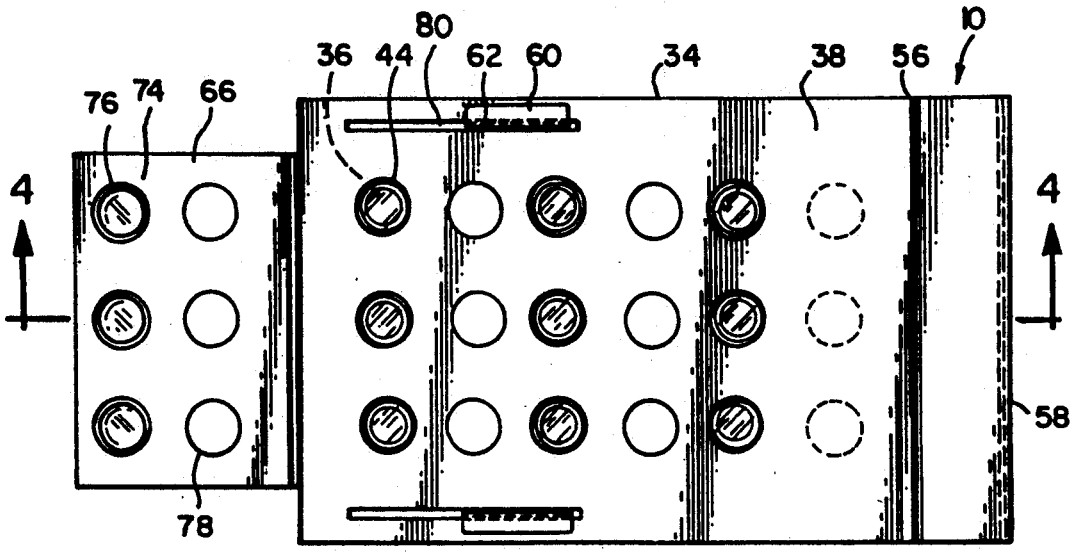
FIG. 3 is a top plan view of the device of FIG. 1, wherein the locking means is in an open position.

As best shown in FIG. 3, the second container 34 comprises a first generally flat sheet 38. The first sheet 38 is formed from a generally compressible, formable material which allows pressure applied to the first sheet 38 to be transmitted to the second articles 36 in an attempt to remove the second articles 36 from the second container 34.

The first sheet 38 of the second container 34 is preferably formed from a formable polymeric or thermoplastic material, such as one or more of the materials which the first sheet 16 may be formed from, as discussed above. The first container 14 and the second container 34 may be formed together from the same materials as shown or each container may be formed separately from different materials.

Figure 4:
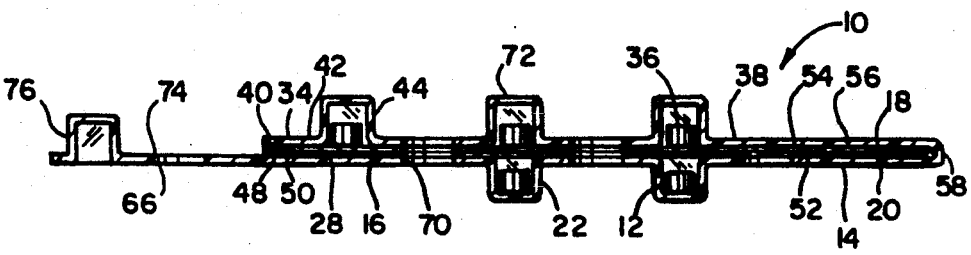
FIG. 4 is a cross-sectional view of the device taken along line 4—4 of FIG. 3.

As best shown in FIG. 4, the first sheet 38 of the second container 34 has a first side 40 and a second side 42. The first sheet 38 also has at least one, and preferably a plurality of, generally outwardly extending second blisters 44 for accommodating the second articles 36. The interior dimensions of the blisters 44 preferably conform to the size and shape of the one or more of the second articles 36 contained therein. One of ordinary skill in the art would understand that the first sheet 38 need not be generally flat, and may have blisters 44 of any size and shape in keeping with the spirit and scope of the present invention.

As best shown in FIG. 7, the second container 34 includes a rupturable or puncturable generally flat second sheet 46. Second sheet 46 is preferably generally rupturable by the second articles 36 in the area of the blisters 44 when a force is applied to a blister 44 for dispensing one or more of the second articles 36. The force may be generated by the pressure of one or more fingers or the thumb of an individual, for example.

Preferably, the second sheet 46 is a metallic foil, such as aluminum foil. However, one of ordinary skill in the art would understand that any other rupturable or puncturable material, such as a plastic material of the type described above in connection with the first sheet 38 or a paper material, may be used for the second sheet 46 of the second container 34.

Furthermore, one of ordinary skill in the art would understand that the second sheet 46 of the second container 34 need not be generally flat, but may have ridges or indentations, etc. Preferably, the second sheet 46 generally conforms in size to the first sheet 38, but one of ordinary skill in the art would understand that the second sheet 46 may be larger or smaller than the first sheet 38, as desired.

As best shown in FIG. 4, the second sheet 46 of the second container 34 has a first side 48 and a second side 50. A portion 52 of the first side 48 of the second sheet 46 sealingly engages a portion 54 of the first side 40 of the first sheet 38 to form the second container 34. The sealed, engaging portions 52, 54 generally do not include the area of the blisters 44. Preferably, the portions 52, 54 are heat-sealed or adhesively engaged to each other. For purposes of clarity in the drawings, the adhesive or heat seal coating is not shown. One of ordinary skill in the art would understand that the portion 52 of the second sheet 46 may be engaged with the portion 54 of the first sheet 38 by some other means, such as by fasteners, etc.

Figure 6:
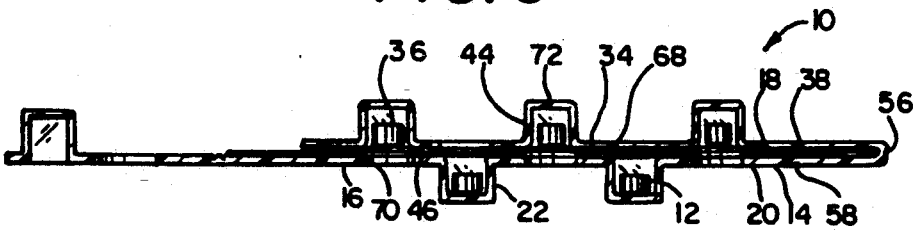
FIG. 6 is a cross-sectional view of the device taken along line 6—6 of FIG. 5.

The second blister package or second container 34, as described above, is a typical blister package, such as the first container 14, well known to those skilled in the art. One or more of the articles 36 may be removed from the second container 34 by applying pressure to an outside surface 72 of a blister 44 to force the article 36 to rupture or puncture the second sheet 46, as shown in FIG. 6. One of ordinary skill in the art would understand that the pressure necessary to puncture the second sheet 46 with the second article 36 is, among other criteria, a function of the shape and compressibility of the second article 36, as well as the compressibility, thickness and type of material from which the first sheet 38 and second sheet 46 are formed.

Preferably, the first container 14 and the second container 34 are positioned as shown in FIGS. 2, 4 and 6 with the second sheets 24, 46 facing each other. The second container 34 is slidably movable with respect to the first container 14 between a first, dispensing position shown in FIG. 6 in which an article 12 may be removed from the first container 14 and a second, non-dispensing position shown in FIG. 4 in which the removal of an article 12 from the first container 14 is prevented.

The first container 14 further includes at least one, and preferably a plurality of openings 70 extending therethrough which are of sufficient size and shape to permit articles 36 from the second container 34 to pass therethrough when the blisters 44 are in registry with the openings 70 and sufficient force is applied to the outside surface 72 of a blister 44 to force an article 36 to rupture or puncture the second sheet 46. The second container 34 also includes at least one, and preferably a plurality of openings 68 extending therethrough which are sized and shaped to permit passage of the first articles 12 therethrough when the blisters 22 of the first container 14 are in registry with the openings 68, as best shown in FIG. 6. Preferably, the size and shape of the openings 68, 70 generally conforms to the size and shape of the articles 12, 36, but one of ordinary skill in the art would understand that the openings 68, 70 may be larger than the size and shape of the articles 12, 36, as desired.

As best shown in FIG. 4, when the second container 34 is in the second position, the second side 50 of the second sheet 46 of the second container 34 is positioned facing the second side 28 of the second sheet 24 of the first container 14 such that the second container openings 68 are not in registry with the first container blisters 22. Therefore, in the second position, the second container 34 functions to inhibit removal of any of the first articles 12 from the first container 14. In the second position, the removal of any of the second articles 36 from the second container 34 is similarly inhibited since the first container openings 70 are not in registry with blisters 44.

As best shown in FIG. 6, when the second container 34 is moved by a user to the first, dispensing position, each of the blisters 22 are in registry with the openings 68 to permit removal of any of the first articles 12 from the first container 14 by applying pressure to an outside surface of the blisters 22. The applied pressure forces the articles 12 to puncture the second sheet 24 of the first container 14 and pass through registered the openings 68. Likewise, the second blisters 44 are in registry with the openings 70 in the first container 14 to permit removal of any of the second articles 36 from the second container 34. The articles 36 are removed from the second container 34 by applying pressure to an outside surface 72 of any of the second blisters 44 to force the articles 36 to puncture the second sheet 46 of the second container 34 and pass through the registered openings 70.

The device 10 preferably includes a first means for maintaining the first and second containers 14 and 34 in close proximity or in engagement while permitting movement of the second container 34 between the first position and the second position. Preferably, the first and second containers 14, 34 are formed from the same materials in a single continuous sheet (see FIG. 7) folded back upon itself, as best shown in FIGS. 4 and 6.

The first means preferably comprises a first fold line 56 in at least one of the first container 14 and the second container 34 and a second fold line 58 in at least one of the first container 14 and the second container 34. Each fold line 56, 58 forms a hinge for permitting movement of the second container 34 between the first and second positions. One of ordinary skill in the art would understand, however, that the first means may be formed by other than folds in the first or second container.

The first means may be formed integrally with the first and/or second containers 14, 34 or separately formed and connected thereto. The first means may be formed from the same materials, such as a polymeric material or metallic foil, as the first and/or second containers 14, 34 as discussed above or from different materials, such as a metallic or paper-like material, for example. The first means may be connected to the first and second containers 14, 34 by a variety of means, such as the use of adhesives, fasteners, heat sealing, mechanical pressing, to mention a few. For example, if the first and second containers 14, 34 were formed separately, hinges may be attached to the containers 14, 34 to permit movement of the second container 34 between the first and second positions.

Figure 5:
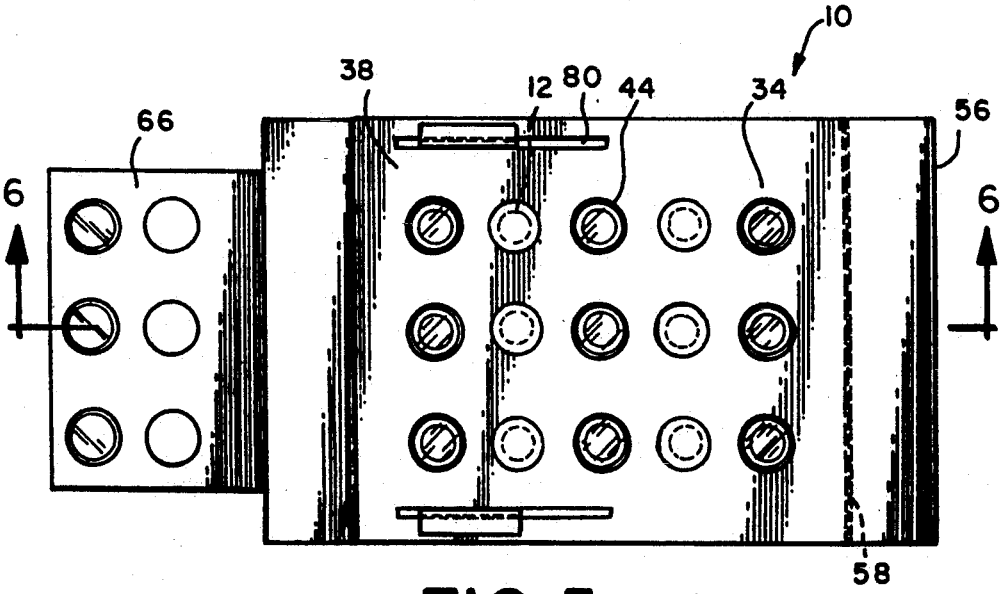
FIG. 5 is a top plan view of the device of FIG. 1, wherein the locking means is in an open position and the first member is in a first position to permit removal of an article from the container.

In a preferred embodiment, as best shown in FIG. 3, when the second container 34 is in the second, non-dispensing position relative to the first container 14, at least one of the first container 14 or the second container 34 is folded at the second fold line 58. As best shown in FIG. 5, when the second container 34 is moved by a user to the first position, the second container 34 is positioned relative to the first container 14 such that at least one of the first container 14 or the second container 34 is folded at the first fold line 56.

It will be appreciated by those skilled in the art that the location of the blisters 22 and 44, the location of the openings 68 and 70 and the location of the fold lines 56 and 58 must be determined in a manner which will permit relative movement of the containers 14 and 34 while maintaining the above-described registry/non-registry relationship between the blisters 22 and 44 and the openings 68 and 70. In the above-described embodiment the first container includes two rows of blisters 22 interspersed within three rows of openings 70 and the second container 34 includes three rows of blisters 44 separated by two rows of openings 68. It will be appreciated that other blister/opening relationships may be established for a particular application and that a change in the blister/opening relationship may also result in a change in the fold lines 56, 58.

The device 10 may further include second means for maintaining the second container 34 proximate the second sheet 2 of the first container 14 and for permitting movement of the second container 34 relative to the first container 14 between the first and second positions. For example, the second means may comprise a first protuberance in one of the first container 14 and/or the second container 34 and a first aperture in the other of the first container 14 and/or the second container 34.

As best shown in FIG. 3, the first protuberance may be at least one, and preferably two tabs 60 formed from a portion of the first container 14 or second container 34. The tabs 60 may include fold lines 62 for securing the tabs 60 in the first aperture. One of ordinary skill in the art would understand that the tabs 60 may be separately formed from the same or a different material from which the first and/or second containers 14, 34 are formed. Separately formed tabs 60 may be secured to the first or second containers 14, 34 by conventional assembly means, such as heat sealing, RF (radio frequency) or sonic welding, or by mechanical press fitting, for example. The tabs 60 shown in FIGS. 1-7 are formed from a portion of the first container 14.

The tabs 60 extend through a first aperture, in the present embodiment a pair of elongated slots 80, extending through the second container 34. When the device 10 is formed by folding along fold lines 56 or 58 the tabs 60 are bent to extend through the slots 80 and thereafter are bent over as shown in FIG. 1 to hold the containers 14 and 34 together. The length of the slots 80 relative to the length of the tabs 60 is selected to permit sliding movement of the containers 14 and 34 between the first and second positions. The bent over tabs 60 may be heated to maintain their positions or other means may be employed for this purpose.

Figure 8:
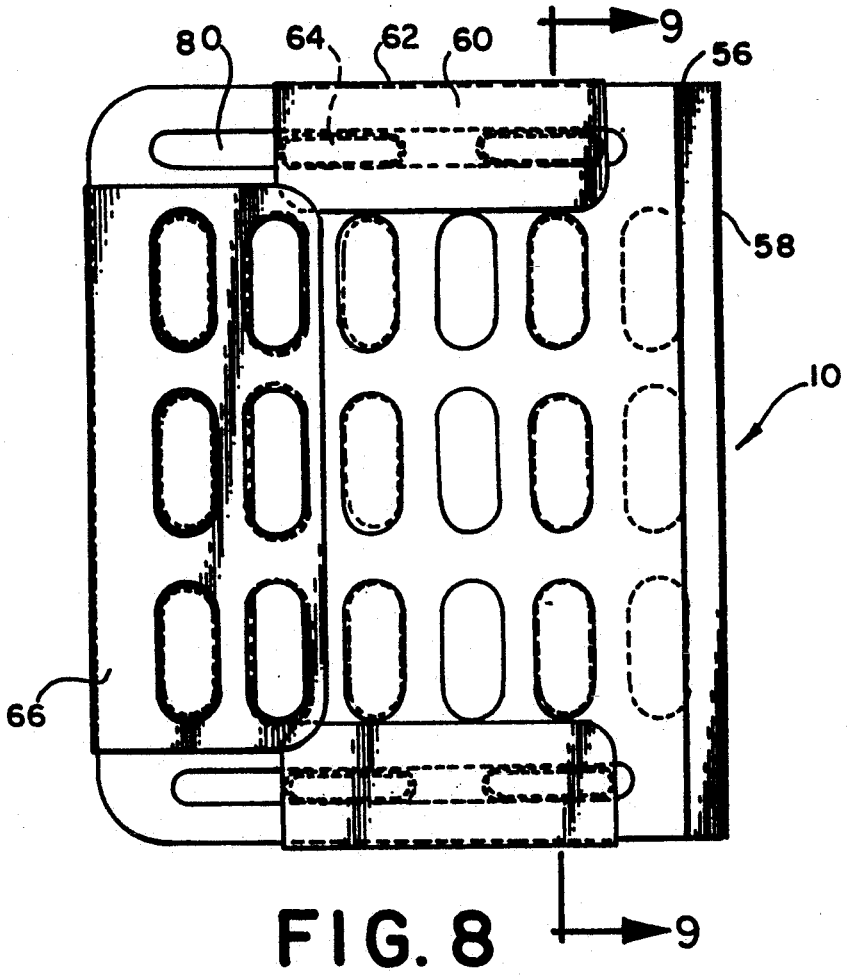
FIG. 8 is a top plan view of another preferred embodiment of a device for inhibiting removal of an article from a blister-type container.
Figure 9:
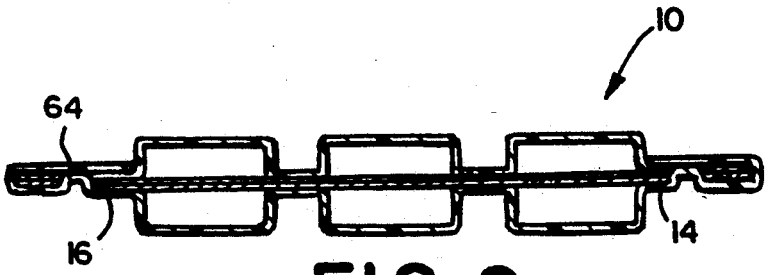
FIG. 9 is a cross-sectional view of the device of FIG. 8 taken along line 9—9 of FIG. 8.

In an alternate preferred embodiment best shown in FIGS. 8 and 9, the tabs 60 are formed from a protruding portion of the first container 14. The tabs 60 may also be formed separately from the same or a different material from which the first container 14 is formed and may be attached to the first container 14 by conventional assembly means, such as those discussed above. One of ordinary skill in the art would understand that the tabs 60 may be positioned on either or both of the first container 14 and the second container 34 in keeping with the spirit and scope of the present invention.

As best shown in FIGS. 8 and 9, the device 10 may further include at least one, and preferably a plurality of guide members 64 formed in one or both of the first container 14 and the second container 34, preferably the same container in which the tabs 60 are formed. The guide members 64 are preferably formed from a portion of the first container 14 in the shape of elongated lugs formed in the same manner as the blisters. The guide members 64 preferably have a portion smaller than the slots 80 in a first direction which permits the guide members 64 to slide in a reciprocating manner within the slots 80. Preferably, the guide members 64 are at least partially positioned within the slots 80.

The tabs 60 may be folded over at fold lines 62 to be secured to a portion of the guide members 64 which protrudes through the slots 80. This arrangement of tabs 60 and guide members 64 permits the first and second containers 14, 34 to be maintained in close proximity while permitting the second container 34 to be moved relative to the first container between the first and second positions. The guide members 64 and tabs 60 may be connected by conventional assembly means, such as heat sealing, RF (radio frequency) or sonic welding, mechanical press fitting, or the use of adhesives, for example. Preferably, the guide members 64 and tabs 60 are connected by an adhesive, which for purposes of clarity is not shown in the drawings.

The device 10, as thus far described, provides a blister-type package which establishes a two-step process for removal of articles, namely, first moving the containers 14, 34 to the first or dispensing position to provide proper registry between the blisters 22, 44 and the openings 68, 70 and second pressing upon the blisters 22, 44. In this manner, it is more difficult for a child to dispense an article than with a typical, standard blister-type container which requires only a single dispensing step of pressing upon the blisters 22, 44.

The device 10 may further include locking means for locking the second container 34 in the second, non-dispensing position, as shown in FIG. 2, and inhibiting sliding movement of the second container 34 with respect to the first container 14 to establish an additional step to further inhibit removal of any of the first and/or second articles 12, 36. Preferably, the locking means includes a second generally flat member 66 extending from the first container 14. The second member 66 is preferably formed together with the first container 14 and the second container 34 from the same materials, although one of ordinary skill in the art would understand that the second member 66 may be formed from a different material than that of either the first container 14 or the second container 34 and connected to the first container 14 by conventional means, such as heat sealing, etc.

As shown in FIG. 7, the second member 66 preferably includes a first side 74 and at least one and preferably a plurality of protuberances 76. In the embodiment shown, the protuberances 76 are formed in the same manner as blisters. Preferably, the protuberances 76 generally correspond in shape but are slightly larger than the first openings 70 and second openings 68 for forming a tight friction or snap fit when the second member 66 is bent over the second container 34 as shown in FIGS. 1 and 2 and the protuberances 76 are inserted in the first and second container openings 70, 68. However, one of ordinary skill in the art would understand that the protuberances 76 may be formed on the first container 14 and a corresponding opening may be formed in the second member 66. The locking means may be formed in a variety of ways to cause a portion thereof which is attached to or formed as a part of the first container 14 to releasably engage portions of the first and second containers 14, 34 such that sliding movement of the second container 34 with respect to the first container 14 is inhibited.

As best shown in FIG. 2, the locking means has a closed position in which the openings 70 in the first container 14 and the openings 68 in the second container 34 are aligned. The first side 74 of the second member 66 is bent over to be in facing engagement with the second side 42 of the first sheet 38 of the second container 34. The protuberances 76 extend into the openings 70 and the openings 68 for inhibiting the second container 34 from moving to the first position and thereby inhibiting the removal of first and/or second articles 12, 36 from the first and/or second containers 14, 34, respectively. An undercut may be provided in the protuberances 76 to permit a snap fit with the openings 70.

As best shown in FIG. 3, the second member 66 may further include openings 78 such that when the locking means is in the closed position, blisters 44 of the second container 34 extend through the openings 78 for further securing the locking means in the closed position and further inhibiting relative movement of the first and second containers 14, 34. The openings 78 generally correspond in shape but are slightly smaller than the second blisters 44 to provide a tight frictional engagement. One of ordinary skill in the art would understand that the openings 78 may conform in size and shape to any protrusion from the second container 34 for locking the second container 34 in the closed position.

The locking means has an open position, best shown in FIGS. 3–6, in which the protuberances 76 are spaced apart from the openings 70 in the first container 14 and the openings 68 in the second container 34 and the blisters 44 are spaced from the openings 78 in the second member 66 such that the second container 34 may be moved between the second and first positions to permit an individual to remove first and/or second articles 12, 36 from the first and/or second containers 14, 34, respectively.

If desired, a separate third sheet (not shown) could be positioned above the first sheet 16 of the first container 14 or below the first sheet 38 of the second container 34 to provide printed information useful or related to the dispensing of the articles 12, 36. For example, dosage information or date information could be applied to the third sheet.

From the foregoing description, it can be seen that the present invention comprises a child-resistant device for inhibiting removal of an article from a blister-type container by making the article removal a three-step process which can only be performed in one order. It will be appreciated by those skilled in the art that changes could be made to the embodiment described without departing from the broad inventive concept thereof. It is understood, therefore, that this invention is not limited to the particular embodiments disclosed, but is intended to cover all modifications which are within the spirit and scope of the invention as defined by the appended claims.

I claim:

1. A device for inhibiting removal of a first article from a first blister package container, said device comprising: a first container comprising a first generally flat sheet having a first side and a second side, a first article and a blister for accommodating said first article and a puncturable generally flat second sheet having a first side and a second side, a portion of said first side of said second sheet engaging a portion of said first side of said first sheet; and a first generally flat member having a first side and a second side, a portion of said first side of said first member in facing engagement with a portion of said second side of said second sheet, said first member being slidably movable in a linear direction generally parallel to said second sheet of said first container between a first position and a second position, said first member including an opening in registry with said blister when said first member is in said first position, said opening being sized to permit passage of said first article therethrough, whereby when said first member is in said second position, said first side of said first member is positioned facing said second side of said second sheet to inhibit removal of said first article from said first container and when said first member is moved by a user to said first position, said blister is in registry with said opening to permit removal of said first article from said first container by applying pressure to an outside surface of said blister to force said first article to puncture said second sheet of said first container and pass through said opening.

2. A device according to claim 1, wherein said first article is selected from the group consisting of pills, tablets, capsules, syringes and suppositories.

3. A device according to claim 1, wherein said first sheet is a thermoplastic material.

4. A device according to claim 3, wherein said thermoplastic material is selected from the group consisting of polyvinyl chloride, styrene, polypropylene, BAREX TM, ACLAR TM, polyethylene terephthalate, polyethylene terephthalate glycol, amorphous polyethylene terephthalate and combinations thereof.

5. A device according to claim 1, wherein said second sheet is a metallic foil.

6. A device according to claim 1, wherein said first container further comprises an opening and said first member comprises a second blister package container, said second container comprising a first generally flat sheet having a first side and a second side, a second article, a second blister for accommodating said second article and a puncturable generally flat second sheet having a first side and a second side, a portion of said first side of said second sheet engaging a portion of said first side of said second sheet engaging a portion of said first side of said first sheet, such that when said second container is positioned to inhibit removal of said first article from said first container, removal of said second article from said second container is inhibited by said first container and when said second container is positioned to permit removal of said first article from said first container, said second blister is in registry with said opening of said first container to permit removal of said second article from said second container by applying pressure to an outside surface of said second blister to force said second article to puncture said second sheet of said second container and pass through said opening of said first container.

7. A device according to claim 6, wherein said first container and said second container are formed together from the same materials.

8. A device according to claim 1, further comprising first means for permitting movement of said first member between said first position and said second position.

9. A device according to claim 7, further comprising first means for permitting movement of said first member between said first position and said second position, said first means comprising a first fold line in at least one of said first container and said first member and a second fold line in at least one of said first container and said first member.

10. A device according to claim 8, wherein said first means comprises first and second hinge members.

11. A device according to claim 1, further comprising means for maintaining said first member proximate said second sheet of said first container and for permitting movement of said first member between said first position and said second position.

12. A device according to claim 11, wherein said means for maintaining comprises a first protuberance in one of said first container and said second container and a first aperture in the other of said first container and said second container, said first aperture being larger than said first protuberance in a first direction so that the first member may be moved between said first and second positions.

13. A device according to claim 12, wherein said first protuberance is a tab and said first aperture is a slot.

14. A device according to claim 13, wherein said tab includes a fold.

15. A device according to claim 12, wherein said means for maintaining further comprises a guide member in one of said first container and said first member which includes said first protuberance, said guide member being positioned within said first aperture and in engagement with said first protuberance.

16. A device according to claim 1, wherein said device further comprises locking means for locking said first member in said second position.

17. A device according to claim 16, wherein said locking means comprises a second generally flat member connected to said first container, said first container having an opening, said second member comprising a first side and a protuberance, said locking means having a closed position in which said opening of said first container and said opening of said first member are aligned and said first side of said second member is in facing engagement with said second side of said first sheet of said first member with said protuberance extending into each of said openings for preventing said first member from moving to said first position and an open position in which said protuberance is spaced from each of said openings such that said first member may be moved between said second and said first positions.

18. A device according to claim 17, wherein said second member further comprises an opening and said first member comprises a second blister, such that when said locking means is in said closed position, said second blister extends through said opening of said second member and when said locking means is in said open position said second blister is spaced from said opening of said second member.

19. A device according to claim 17, wherein said second member is formed together with said first container and said first member from the same materials.

* * * * *